United States Patent [19]

Jacobson

[11] Patent Number: 4,715,068

[45] Date of Patent: Dec. 29, 1987

[54] GARMENT AND LINER COMBINATION

[76] Inventor: Milton D. Jacobson, 3300 Faring Rd., Birmingham, Ala. 35223

[21] Appl. No.: 29,185

[22] Filed: Mar. 23, 1987

[51] Int. Cl.[4] ..... A41D 27/02

[52] U.S. Cl. ..... 2/272; 2/DIG. 6

[58] Field of Search ..... 2/272, DIG. 6, 271, 2/269, 227, 97

[56] References Cited

U.S. PATENT DOCUMENTS

| | | | |
|---|---|---|---|
| 3,083,737 | 4/1963 | Demestral | 2/DIG.6 |
| 3,691,564 | 9/1972 | La Meirro et al. | 2/97 |
| 3,950,789 | 4/1976 | Konz et al. | 2/DIG. 6 X |
| 4,470,155 | 9/1984 | Maeshima | 2/97 |
| 4,507,806 | 4/1985 | Coombs | 2/97 |

*Primary Examiner*—Ronald Feldbaum

*Attorney, Agent, or Firm*—Jennings, Carter, Thompson & Veal

[57] ABSTRACT

A garment construction wherein a liner is held within an outer portion utilizes a plurality of straps and hook and pile fasteners to eliminate buttons, snaps and zippers and facilitate the interchangeability of liners of various insulative characteristics.

8 Claims, 4 Drawing Figures

GARMENT AND LINER COMBINATION

FIELD OF THE INVENTION

The present invention relates to garments having removable liners and more particularly to garments wherein the liner is selected in accordance with the temperature. Even more particularly, the present invention relates to garments having removable liners having an improved means for attaching said liners to said garments.

BACKGROUND OF THE INVENTION

Garments having removable liners are well known and, with the advent of low-bulk insulating materials, such liners are amenable to selection in accordance with the temperature range in which the garment is to be worn. Typically, garments are sold with a single liner which, if removable, allows the outer portion to be worn alone or in conjunction with the liner as conditions warrant. While such combinations as are known have enjoyed some success, the means by which the liner and outer portion are joined together have occasioned considerable annoyance. The known methods of joining the outer portion and liner are by buttons and cooperative buttonholes, by zippers, or by snaps. Buttons and snaps suffer some of the same disabilities. For example, where the garment is subjected to rough wear, as in a set of overalls, the fabric connecting the button or snap becomes weakened and one or more of the fasteners is eventually lost. Secondly, in attempting to fasten the liner in the outer portion, misalignment of the button or snap with its proper mate leads to misalignment of the liner and outer portion, which is a frustrating experience. Also, if more than one liner is to be used with the garment, the buttonholes and snaps or zippers for each piece must match. Zippers, of course, lose teeth, become snagged in the fabric or burst under heavy use and all of the above present hard objects at a variety of places in the garment which may render the garment uncomfortable in a number of uses.

I have recently attempted to attach the liner and outer portion with hook and pile surfaces cooperatively sewn to the members, however, such an arrangement is somewhat unsuitable in as much as when either the garment or liner is washed separately lint and debris accumulate on the fastener surface.

SUMMARY OF THE INVENTION

It is the object of my invention to provide a garment which has a removable and interchangeable liner in which the fastening means is substantially universal from liner to liner such that mismatches in the fastener do not occur.

Another object is to provide a garment as above wherein the fastening means is impervious to damage or loss.

Another object is to provide a garment as above wherein the fastening means facilitates the alignment of the outer portion and the liner.

Another object of the invention is to provide a garment as above wherein the fastener does not create any discomfort to the wearer.

Yet another object of the invention is to provide a garment as above wherein the fastener means may be protected from contamination as during washing of the garment.

BRIEF DESCRIPTION OF THE DRAWINGS

Garments embodying features of my invention are depicted in the accompanying drawings which are a part of this application and wherein.

DESCRIPTION OF A PREFERRED EMBODIMENT

Figure 1:
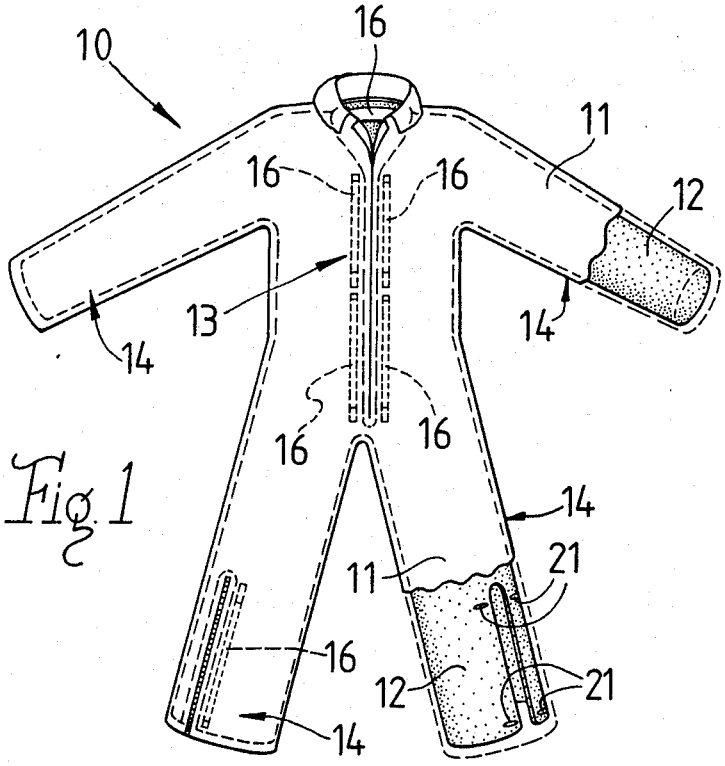
FIG. 1 is an elevational view of a garment in the form of coveralls partially cut-away to show the liner.

Referring to FIG. 1, it may be seen that the present invention is susceptible to use as a coverall or work garment 10 having an outer portion 11 and a liner 12. It is to be understood that the garment may be of any convenient configuration such as a coat, cloak, jacket, pants or coveralls in which the outer portion 11 and liner 12 are generally conformal over an area of the garment. The garment 10 further may have a closure portion 13 which facilitates donning the garment 10 by a wearer and parts 14 such as sleeves and legs for covering the appendages of the wearer.

My invention departs from conventional garments having removable liners by providing a simpler, more efficient and more adaptable means for connecting the outer portion 11 and the liner 12.

Figure 4:
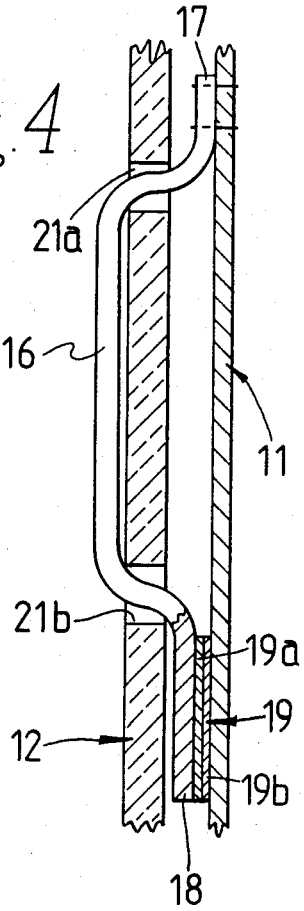
FIG. 4 is a sectional view taken adjacent one of the fasteners utilized in the garment depicted in FIG. 1.
Figure 2:
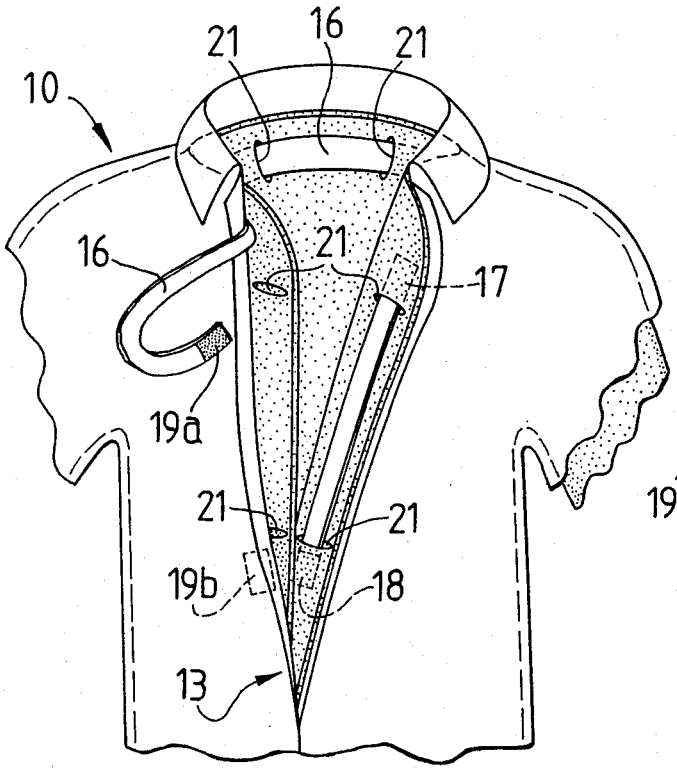
FIG. 2 is a partial detail of the closure portion of the garment depicted in FIG. 1.
Figure 3:
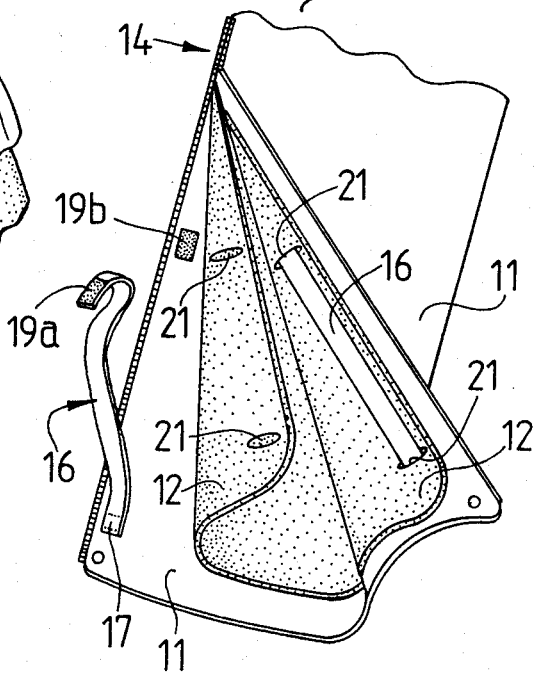
FIG. 3 is a partial detail of one of the leg members of the garment depicted in FIG. 1.

Referring to FIGS. 2–4, it may be seen that I provide a strap member 16 which is attached at one end 17 to the inside of the outer portion 11 of garment 10 by sewing the strap 16 securely thereto. The free end 18 of the strap 16 carries one half of a hook and pile fastener 19 of the type sold under the trademark Velcro ®. The other half of the fastener 19 is sewn into the outer portion 11 at a cooperative distance such that the fastener halves 19*a* & *b* may be joined without distorting the outer portion 11 and without excessive slack in strap 16. The liner 12 has formed therein slits 21*a* & *b* at positions closely adjacent the one end 17 and the fastener 19 when the liner 12 is placed in conformal relationship with the outer portion 11. The strap member 16 is inserted through the slits 21*a* & *b* and the free end 18 is then fastened by fastener 19. Thus a plurality of such straps 16 are able to completely secure the liner 12 to the outer portion in a most advantageous manner.

As shown in FIG. 2, the closure portion 13 of the garment has provided therein a plurality of strap members 16 and slits 21 along the front opening and across the back of the neck opening. Further strap members 16 or slits may be formed in the appendages as shown in FIGS. 1 and 3.

From the foregoing, it may be seen that I have described a novel garment construction which eliminates lost buttons, stuck zippers, deformed snaps and which provides a completely satisfactory means by which a liner may be secured in the garment. Furthermore, cooperation between buttons and buttonholes is eliminated in that as long as slits 21*a* & *b* are intermediate the ends of the strap member 16 and are of sufficient width to pass the strap member therethrough, the garment may be assembled. This greatly facilitates the use of multiple liners having various insulating characteristics in that the size of buttons, holes, or snaps is eliminated as a consideration. Also by securing both the fastener 19 and strap member 16 to the outer portion 11, it is clear that the fastener may be secured during washing to avoid an accumulation of lint thereon.

While I have shown my invention in one form, it will be obvious to those skilled in the art that it is not so limited but is susceptible of various changes and modifications without departing from the spirit thereof.

What I claim is:

1. A garment adaptable for use in various temperatures wherein the insulating qualities of the garment may be varied comprising:

(a) an outer portion wearable as a garment;

(b) a liner having insulating qualities determined in accordance with the temperature and wearable within said outer portion;

(c) a plurality of strap members affixed at one end thereof to the inside of said outer portion and having a free end;

(d) hook and pile fastening means affixed to said free end and the inside of said outer portion such that said free end may be secured to said outer portion; and (e) means formed in said liner for allowing the passage of said strap members therethrough.

2. A garment as defined in claim 1 wherein said means for allowing the passage of said strap member comprises a pair of slits formed in said liner cooperatively positioned therein adjacent said one end of strap and adjacent said hook and pile fastener means when said liner is inserted within said outer portion in conforming relationship thereto.

3. A garment as defined in claim 2 wherein said outer portion and said liner have closure portions thereon to permit donning said garment by a wearer and wherein said strap members are located proximal said closure portions to secure said liner to said outer portion.

4. A garment as defined in claim 3 wherein said outer portion and said liner include integral parts thereof covering appendages of the wearer and wherein said strap members are cooperatively positioned within said parts to secure said liner to said outer portion.

5. A garment as defined in claim 2 wherein said outer portion and said liner include integral parts thereof covering appendages of the wearer and wherein said strap members are cooperatively positioned within said parts to secure said liner to said outer portion.

6. A garment as defined in claim 1 wherein said outer portion and said liner have closure portions thereon to permit donning said garment by a wearer and wherein said strap members are located proximal said closure portions to secure said liner to said outer portion.

7. A garment as defined in claim 6 wherein said outer portion and said liner include integral parts thereof covering appendages of the wearer and wherein said strap members are cooperatively positioned within said parts to secure said liner to said outer portion.

8. A garment as defined in claim 1 wherein said outer portion and said liner include integral parts thereof covering appendages of the wearer and wherein said strap members are cooperatively positioned within said parts to secure said liner to said outer portion.

* * * * *